US005666826A

United States Patent [19]

Mista

[11] Patent Number: 5,666,826

[45] Date of Patent: Sep. 16, 1997

[54] NEEDLE MOUNTING DEVICE FOR WARP KNITTING MACHINES

[75] Inventor: Kresimir Mista, Heusenstamm, Germany

[73] Assignee: Karl Mayer Textilmaschinenfabrik GmbH, Obertshausen, Germany

[21] Appl. No.: 490,765

[22] Filed: Jun. 15, 1995

[30] Foreign Application Priority Data

Jun. 18, 1994 [DE] Germany ..... 44 21 388.3

[51] Int. Cl.[6] ..... D04B 27/06

[52] U.S. Cl. ..... 66/114

[58] Field of Search ..... 66/114, 207, 208

[56] References Cited

U.S. PATENT DOCUMENTS

| | | | |
|---|---|---|---|
| 601,281 | 3/1898 | Salisbury | 66/114 |
| 2,962,883 | 12/1960 | Dolinsky | 66/86 |
| 3,823,581 | 7/1974 | Russo | 66/114 X |
| 4,683,727 | 8/1987 | Zorini | 66/207 |

FOREIGN PATENT DOCUMENTS

| | | | |
|---|---|---|---|
| 103042 | 5/1874 | France | 66/114 |
| 2444740 | 8/1980 | France | 66/114 |
| 122695 | 9/1899 | Germany | 66/114 |
| 1031466 | 11/1958 | Germany . | |
| 1435142 | 10/1968 | Germany . | |
| 94072736 | 5/1994 | Germany . | |

OTHER PUBLICATIONS

German patent application No. PA 300640, May 7, 1962.

*Primary Examiner*—John J. Calvert

*Attorney, Agent, or Firm*—Omri M. Behr, Esq.

[57] ABSTRACT

A holding device can holding implements for a knitting machines such as needles or guides. A needle (or guide) head (2) is held detachably on a carrier (9) by means of plug-type connections and a locking device. The needle head (2) is connected in one piece with a shank (3), which is flat and has a lateral recess (16) near its end. A holder (4) is arranged on the carrier (9). Following a guide section (19) matched to the shank cross section, the holder has a sprung catch (15) movable in the shank plane perpendicular to the shank axis. This catch can engage the recess (16) under pretension. More particularly, the holder (4) has between two external cover plates(6, 7), a middle plate (5) having free punchings forming the guide section (19) and the spring tongue (14). In this way the needle heads can be easily replaced individually.

20 Claims, 2 Drawing Sheets

Fig.1
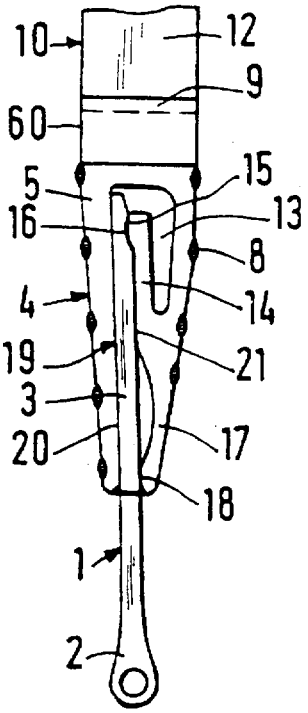
Fig.2
Fig.7
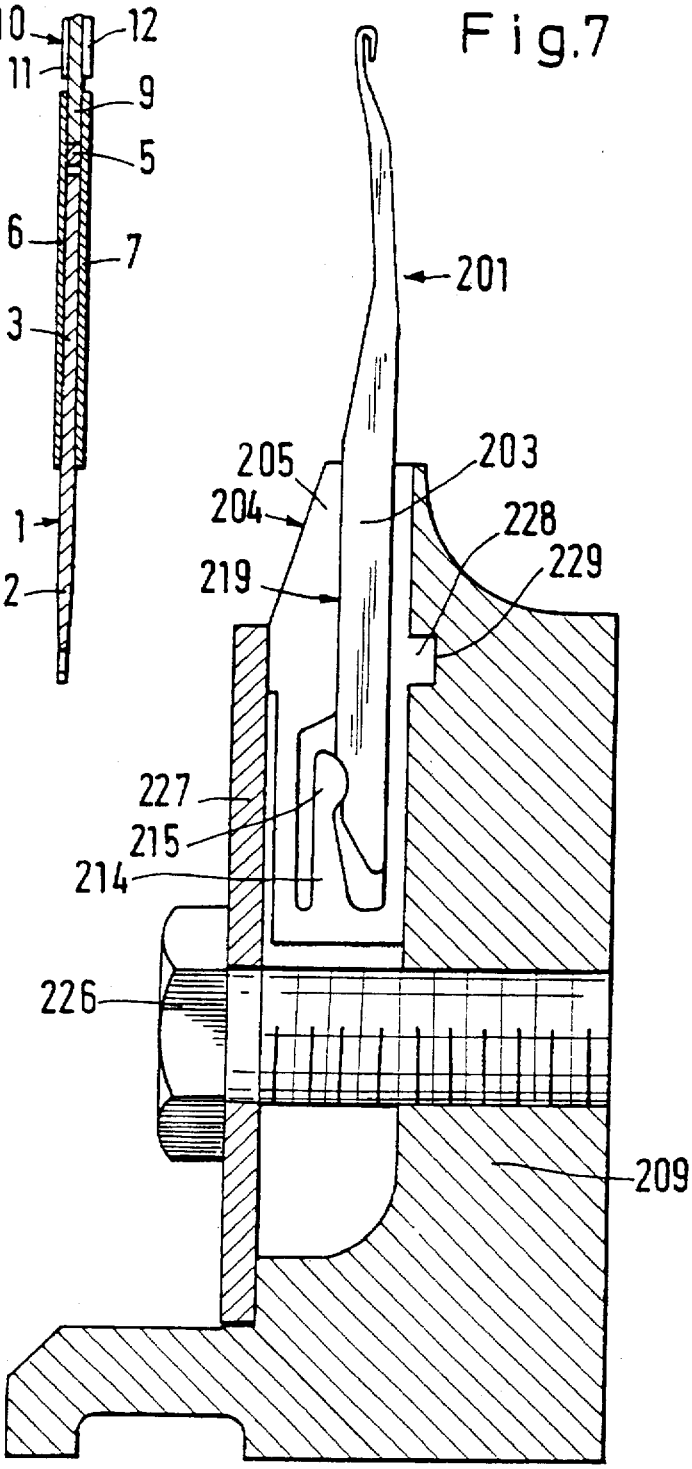
Fig.3
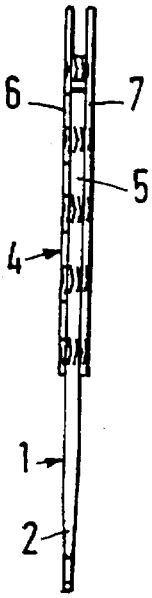

NEEDLE MOUNTING DEVICE FOR WARP KNITTING MACHINES

FIELD OF THE INVENTION

The present invention relates to a needle mounting device for warp knitting machines, in which the needle head is held detachably on a carrier by means of a plug-type connector having a holder and a locking device for securing the operating position.

DESCRIPTION OF RELATED ART

In a known needle mounting device (DE-OS 14 35 142) a flat shank of rectangular cross section is cast in lead over part of its length. The needle head has a holder bent from sheet metal, the cross section of which corresponds to the shank cross section. A catch pressed out of the shank is intended to engage a recess in the wall of the holder in order to determine the operating position of the needle head.

In this way the needle head, which is exposed to wear, can be replaced by way oaf the old needle head being extracted off and a new needle head being installed. However, as the catch increases the thickness of the shank it makes this pulling off and placing on difficult with the forces available. If a slightly wider holder is provided the needle head is not held without play and can fall out during knitting. In addition to this, the manufacture of this needle mounting device is very laborious and costly, and it requires much space. Furthermore the shanks can be damaged during changing of the needle heads.

Also known (DE-PS 10 31 466) is the provision of the needle heads in one piece with a shank, the placing of the shanks in parallel grooves of a block, and determining the operating position by engaging an angled end in guide holes and holding a group of shanks in place by means of a joint sprung clamping plate. Individual needles can also be replaced in this case. However, the block must previously be freed and the sprung clamping plate removed. Simply pulling out a needle to be replaced and inserting a new needle is not possible.

An object of the present invention is to achieve a needle (or guide) mounting device of the initially described type which allows simple replacement of the needle heads by removing and installing, at the same time to provide accurately positioned and play-free attachment.

SUMMARY OF THE INVENTION

In accordance with the illustrative embodiments demonstrating features and advantages of the present invention, there is provided a holding device for holding, with a plug-in type connection, implements such as needles or guides in a knitting machine. The holding device includes a knitting implement having a shank with a longitudinal flat surface. The knitting implement has an inside end with a lateral recess. The holding device also has a carrier and a holder mounted on the carrier. The holder has a locking device and a guide section matching a profile of the shank. The locking device can hold the knitting implement in an operating position. The locking device also has a sprung catch reciprocatable transversely to the length of the shank axis in a direction parallel to the flat surface. The catch is arranged to engage the recess pretensioned.

Thus a preferred needle (or guide) head is connected in one piece with the shank, which is flat and has a lateral recess near its end. The preferred holder is arranged on the carrier and has, following a guide section matched to the shank cross section, a sprung catch moveable in the shaft plane perpendicular to the axis of the shank section, which engages the recess pretensioned.

In this design the shank, a comparatively long component, is available for connection to the holder. This results in a secure hold. The precise operating position is determined by the catch engaging in the recess. As the sprung, moveable catch moves in the shank plane perpendicular to the shank axis, a comparatively large spring travel is available. It is therefore not difficult to select the pretension acting in the locking position in such a way that the axial forces possibly occurring in operation cannot loosen the locking connection, while manual forces are more than sufficient to pull out or push in the needles. The needles can therefore be replaced individually without an dismantling of the other components, for example if a needle is worn or has another defect, or if a changed thread material requires a different form of needle.

The term "needle" or "implement" is intended here to cover all conventional knitting machine implements, such as knitting needles or thread guides, and also all similar elements such as sinkers, pile fingers, holding-down sinkers, etc.

Preferably, the catch is formed by a sprung tongue extending in the direction of the shank. By selecting the length and cross sectional dimensions of the tongue, the pretensioning can be selected accordingly. Advantageously, the shank will be provided with a bevelled surface by means of which the catch, on inserting the shank into the holder, can be moved from its neutral position into a deflected position. With further insertion from the deflected position, the catch can reach the locking setting in the recess by spring restoration. Similarly it is advantageous for the recess to have an oblique surface, by means of which the catch, on pulling the shaft out of the holder, is moved into a deflected position from which is reaches the neutral position by spring restoration on further extraction. The height of the plateau between the recess and the bevelled surface determines the required catch movement for reaching the deflected setting and thus the force to be overcome on inserting and/or pulling out.

It is also of advantage for the catch and recess to be rounded. In this way the insertion and pulling out is further facilitated.

In terms of design it is advantageous for at least one holder to be formed of a middle plate, having approximately the thickness of the shank, and free punchings forming the guide section and the sprung tongue. Also, two external cover plates embrace the middle plate and are connected to each other. The tongue is part of the middle plate and, unconventionally, springs in the plane of the plate. As the three plates lie on each other, a very stable holder is attained. It can therefore be of considerable length, which in turn benefits the accuracy of positioning of the needle head.

It is recommended that the intermediate and cover plates are connected to each other at the edge by welding. Connection at the edge alone is sufficient to hold the plates together. In addition, welding, more particularly laser welding, can be carried out there without difficulty.

In an alternative, the cover plates are thinner than the middle plate to form a single holder. The single holder can be arranged next to each other without obstructing each other. Such a single holder is also suitable for individually moveable needles of a Jacquard control type.

In a further embodiment the cover plates can project beyond the middle plate and take up a flat carrier between them. This produces a particularly simple design.

More particularly, the carrier can be in strip form and be part of a piezoelectric bending converter. Such bending converters are of interest for Jacquard controls. To replace a needle head the entire bending converter does not need to be replaced, but just the needle head can be removed, including the shank.

In an additionally preferred alternative a stack, comprising middle and cover plates alternately, is provided for forming a group of holders. Here, one cover plate is allocated to two adjacent holders. The thickness of the cover plate depends on the required needle pitch.

Advantageously the stack is welded as a whole on the edge and attached as a unit to a carrier. Optionally the entire stack or each individual needle can be replaced.

It has proved advantageous for the distance between the catch and the start of the guide section to be at least equal to 8 times the shank width. The great length results in particularly high positioning accuracy.

It is also recommended that at the beginning of the guide section a second sprung tongue rests on the shank pretensioned to press the latter against a guide surface of the holder. This facilitates insertion, as the guide section only guides firmly over a short length. Otherwise the shank is pressed by two pretensioned tongues against a guide surface of the holder.

More particularly, the second tongue can be formed in an area of the middle plate free of edge connections. A very compact design is produced.

Furthermore, it is recommended that the middle and/or cover plate are made of high strength aluminum. This material is extremely light so that a lightweight needle bar is produced, permitting high machine operating speeds.

BRIEF DESCRIPTION OF THE DRAWINGS

The invention is described in more detail below in connection with the preferred embodiments shown in the accompanying drawings, wherein:

FIG. 1 shows a side view of a holding device with a cover plate removed, holding a knitting implement, in accordance with the principles of the present invention.

FIG. 2 is a longitudinal section through the arrangement of FIG. 1.

FIG. 3 is a left side view of the arrangement of FIG. 1.

FIG. 7 is a cross section through a knitting needle bar showing a holding device that is an alternate to that of FIG. 1.

DETAILED DESCRIPTION OF PREFERRED EMBODIMENTS

Figure 5:
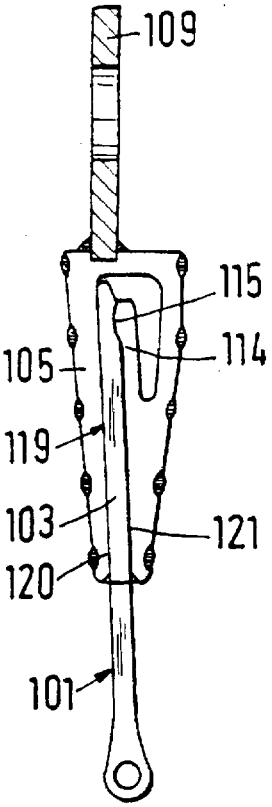
FIG. 5 is a section through a holding device having several holder and which is an alternate to that of FIG. 1.

FIGS. 1 to 3 shows a needle holder device in which a needle 1, designed as a thread guide, has a needle head 2 and a shank 3. Shank 3 is flat and has a rectangular cross section, formed in one piece therewith. The shank is inserted into a holder 4 comprising one middle plate 5 and two outer cover plates 6 and 7, which are connected to each other at the edge by spaced weld seams 8. More particularly this is laser welding. The cover plates 6 and 7 project upwards beyond the middle plate 5 and between them take up a strip carrier 9 with which they are stuck together, for example. The carrier is part of a piezoelectric bending converter 10 and has a piezoelectrically activated coating 11 and 12 on both sides. If the coating 11 is activated by applying a voltage, the needle head 2 moves to the left, and if the right coating 12 is activated by applying a voltage, the needle head 2 moves to the right.

The middle plate 5 was punched out with free punchings 13 to form a first tongue 14 having a catch 15. Catch 15 engages a lateral recess 16 of the shank 3. A second tongue 17 rests with its free end 18 in the shank 3. Both tongues, located in unconnected areas of the three plates, can move under the influence of the shank within the framework of their elastic deformability in the plane of the shank 3 and perpendicular to its axis. A guide section 19 for shank 3 is limited by the two cover plates 6 and 7, a continuous guide surface 20 on one side and a shorter guide surface 21 and the head of the tongue 17 on the other side. Both tongues press the shank 3 against the guide surface 20. The catch 15 secures the axial operating position of the needle 1. The needle 1 can be pulled out by manual forces and replaced by inserting a new needle, as is explained in more detail in connection with FIG. 4.

Figure 4:
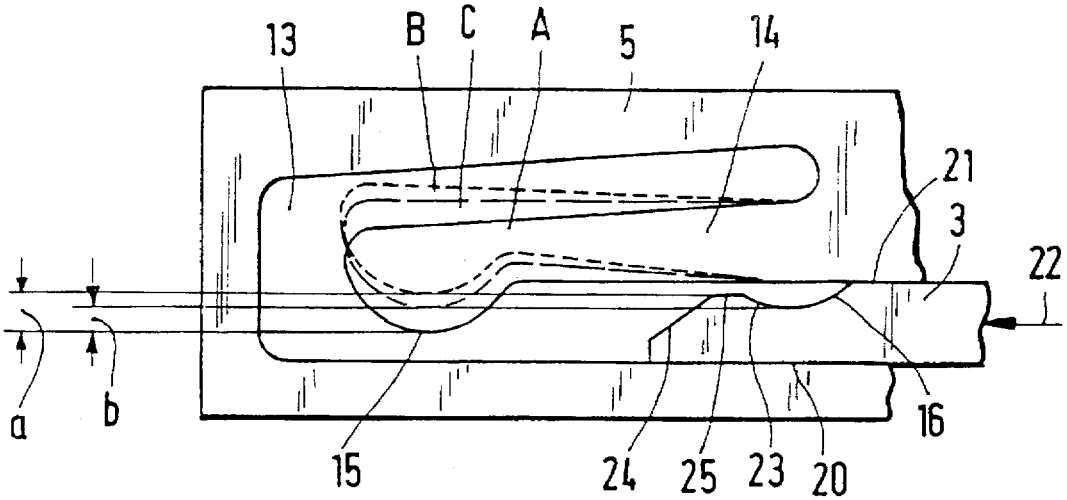
FIG. 4 is detailed view of a portion of the holder of FIG. 1 with the cover plate removed.

In FIG. 4 the middle plate 5 is shown with its free punching 13, the tongue 14 with the catch 15 and the guide surfaces 20 and 21. The shank 3 carries out the insertion movement (arrow 22) but has not yet reached the end position. The lateral recess 16 with an oblique surface 23, a further bevelled surface 24 and an intermediate elevation 25 can be seen. The tongue 14 is shown in three positions. In setting A (continuous line) the tongue is in its neutral position, from which it can be displaced, by way of the bevelled surface 24, into a deflected position B (short broken lines) determined by the elevation 25. On further insertion of the shank 3, the tongue 14 returns to its catch position C (long dashed line) as result of its spring force.

The tongue 14 is thus first of all moved from its neutral position A over distance a, overcoming the elastic restoring forces. The thus occurring spring force determines the force with which the shank must be inserted or pulled out. In the locking position the tongue 14 is moved distance b from its neutral position. The thus occurring pretensioning ensures that the shank 3 remains securely in place during knitting. Bending of the tongue 14 takes place completely within the elastic range.

Figure 6:
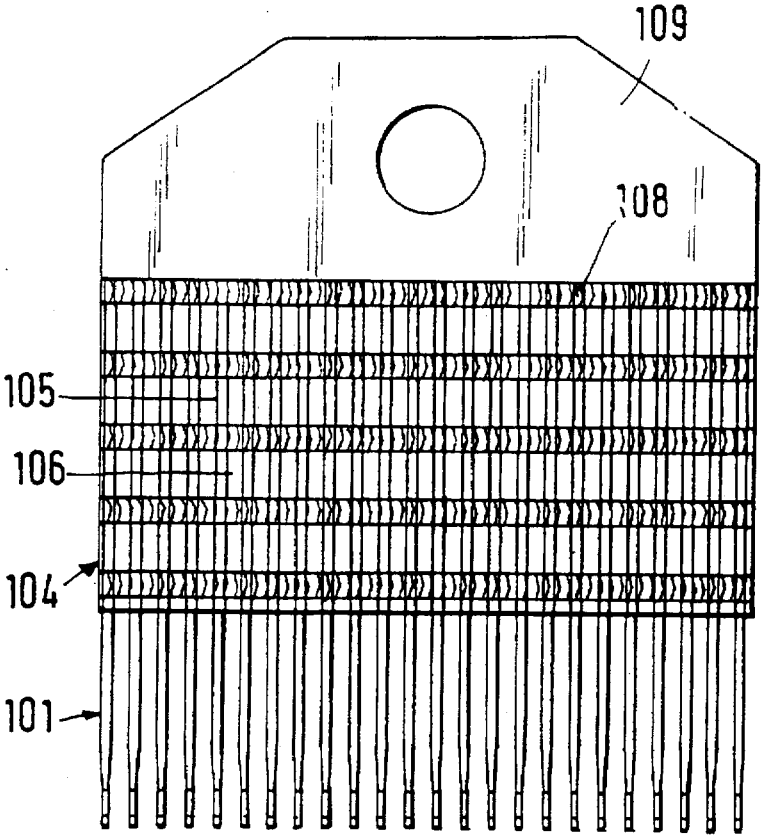
FIG. 6 is a side view of the arrangement according to FIG. 5.

FIGS. 5 and 6 show an embodiment in which a group of holders 104 for a larger number of needles 101 is envisaged. The group is formed by a stack being formed of alternating middle plates 105 and cover plates 106, connected to each other at the edge and to a carrier plate 109 by welding seams 108. The thickness of the cover plates 106 is selected to produce the required needle pitch. The shape of the middle plate 105 largely corresponds to FIG. 1. However, only one tongue 114 with the catch 115 is envisaged. The guide section 119 is formed by two longer guide surfaces 120 and 121. Such a group can be assembled and replaced as a whole on a bar. The needles 101 can however be replaced individually.

FIG. 7 shows another exemplary embodiment in which a group of holders 204 is firmly attached by means of a screw 226 and a clamping plate 227 to a carrier 209, i.e. a bar. The group has a positioning catch 228 which engages in a corresponding groove 229 on the carrier 209.

In turn the group is built up of alternating middle plates 205 and cover plates, which are not shown. A spring 214 with a catch 215 is arranged in the middle plate 205 and extends in the direction opposite to the insertion direction of the shank 203 of the needle 201, which in this case is formed as a knitting needle with hooked needle head. With regard to the guide section 219 the design of FIG. 7 corresponds to that of FIG. 5.

The middle and cover plates can be made of conventional steel plate, but preferably of the considerably lighter material aluminum. The plates can be very simply produced by punching. They can be automatically collected and welded to each other.

I claim:

1. A holding device for holding, with a plug-in type connection, at least one implement for a knitting machine, implements in the knitting machine including needles and guides, said holding device comprising:

a knitting implement having a shank with a longitudinal shank axis and a longitudinal flat surface, said knitting implement having an inside end with a lateral recess;

a carrier;

a holder mounted on the carrier and comprising:

(a) a guide section matching a profile of the shank, said guide section having an internal guide surface and a mouth for receiving said shank, and (b) a locking device for holding the knitting implement in an operating position, said locking device having a sprung catch reciprocatable transversely to the longitudinal shank axis in a direction parallel to the flat surface, said catch being arranged to engage the recess pretensioned, said catch having a sprung tongue extending alongside the shank, said guide surface being located between said sprung tongue and said mouth, said guide section being operable to restrain displacement of the implement transverse to the longitudinal shank axis, independent of relative displacement between said shank and said sprung catch.

2. A holding device according to claim 1, wherein the shank is provided with (a) a recess for engaging said catch, and (b) a beveled surface for moving the catch from a neutral position to a deflected position during initial insertion of the shank into the holder, said recess being spaced from said beveled surface and being sized to allow said catch to settle to a locking position in response to further insertion of said shank in said holder.

3. A holding device according to claim 2, wherein the recess has an oblique surface for moving the catch from the locking position to the deflected position in response to initial extraction of the shank from the holder before full extraction when the catch reaches the neutral position through spring restoration.

4. A holding device according to claim 3, wherein the catch and the recess are rounded.

5. A holding device according to claim 1 wherein at least one holder comprising:

a middle plate having a thickness approximating that of the shank and being punched out to form the guide section and the sprung catch; and two outer cover plates connected together, and positioned on opposite sides of said middle plate.

6. A holding device according to claim 5, wherein:

a pair of sprung tongues, a second one of the tongues being adapted to engage the shank near the mouth of the guide section pretensioned to press the shank against the guide surface of the holder.

7. A holding device according to claim 6, wherein the second one of the tongues is located in a region of the middle plate free of peripheral connections.

8. A holding device according to claim 5, wherein the middle and the cover plates are connected together by peripheral welds.

9. A holding device according to claim 8, wherein said middle plate and said cover plates are accompanied by a plurality of middle plates and a plurality of cover plates grouped as a stack having middle plates alternating with cover plates.

10. A holding device according to claim 8, wherein the cover plates are thinner than the middle plate and together form a single unit.

11. A holding device according to claim 5 wherein the cover plates are thinner than the middle plate and together form a single unit.

12. A holding device according to claim 5 wherein said middle plate and said cover plates are accompanied by a plurality of middle plates and a plurality of cover plates grouped as a stack having middle plates alternating with cover plates.

13. A holding device according to claim 12, wherein the stack is peripherally welded and attached as a unit to the carrier.

14. A holding device according to claim 13, wherein the catch is spaced a predetermined distance from an outward border of the guide section that is distal from the catch, said predetermined distance being at least 8 times the width of the shank.

15. A holding device for holding, with a plug-in type connection, at least one implement for a knitting machine, implements in the knitting machine including needles and guides, said holding device comprising:

a knitting implement having a shank with a longitudinal shank axis and a longitudinal flat surface, said knitting implement having an inside end with a lateral recess;

a carrier; and at least one holder mounted on the carrier and comprising:

a middle plate having a thickness approximating that of the shank, being punched out, and including:

(a) a guide section matching a profile of the shank, and (b) a locking device for holding the knitting implement in an operating position, said locking device having a sprung catch reciprocatable transversely to the longitudinal shank axis in a direction parallel to the flat surface, said catch being arranged to engage the recess pretensioned, and two outer cover plates connected together, positioned on opposite sides of said middle plate, and projecting beyond the middle plate and embracing the carrier, which is flat, the cover plates being thinner than the middle plate and together forming a single unit.

16. A holding device according to claim 15, wherein the carrier comprises a strip having a piezoelectric bending transducer.

17. A holding device for holding, with a plug-in type connection, at least one implement for a knitting machine, implements in the knitting machine including needles and guides, said holding device comprising:

a knitting implement having a shank with a longitudinal shank axis and a longitudinal flat surface, said knitting implement having an inside end with a lateral recess;

a carrier; and a holder mounted on the carrier and comprising:

(a) a guide section matching a profile of the shank, and (b) a locking device for holding the knitting implement in an operating position, said locking device having a sprung catch reciprocatable transversely to the longitudinal shank axis in a direction parallel to the flat surface, said catch being arranged to engage the recess pretensioned, the catch being spaced a predetermined distance from an outward border of the guide section that is distal from the catch, said predetermined distance being at least 8 times the width of the shank.

18. A holding device for holding, with a plug-in type connection, at least one implement for a knitting machine, implements in the knitting machine including needles and guides, said holding device comprising:

a knitting implement having a shank with a longitudinal shank axis and a longitudinal flat surface, said knitting implement having an inside end with a lateral recess;

a carrier; and a holder mounted on the carrier and comprising:

(a) a guide section matching a profile of the shank, said guide section having an internal guide surface and a mouth for receiving said shank, and (b) a locking device for holding the knitting implement in an operating position, said locking device having a sprung catch reciprocatable transversely to the longitudinal shank axis in a direction parallel to the flat surface, said catch being arranged to engage the recess pretensioned, said sprung catch comprising:

a pair of sprung tongues, a second one of the tongues being to engage the shank near the mouth of the guide section pretensioned to press the shank against the guide surface of the holder.

19. A holding device for holding, with a plug-in type connection, at least one implement for a knitting machine, implements in the knitting machine including needles and guides, said holding device comprising:

a knitting implement having a shank with a longitudinal shank axis and a longitudinal flat surface, said knitting implement having an inside end with a lateral recess;

a carrier; and at least one holder mounted on the carrier, being at least partially made of high-strength aluminum, and comprising:

a middle plate having a thickness approximating that of the shank, being punched out, and including:

(a) a guide section matching a profile of the shank, and (b) a locking device for holding the knitting implement in an operating position, said locking device having a sprung catch reciprocatable transversely to the longitudinal shank axis in a direction parallel to the flat surface, said catch being arranged to engage the recess pretensioned; and two outer cover plates connected together, and positioned on opposite sides of said middle plate.

20. A holding device for holding, with a plug-in type connection, at least one implement for a knitting machine, implements in the knitting machine including needles and guides, said holding device comprising:

a knitting implement having a shank with a longitudinal shank axis and a longitudinal flat surface, said knitting implement having an inside end with a lateral recess;

a carrier; and at least one holder mounted on the carrier and comprising:

a middle plate having a thickness approximating that of the shank, being punched out, and including:

(a) a guide section matching a profile of the shank, and (b) a locking device for holding the knitting implement in an operating position, said locking device having a sprung catch reciprocatable transversely to the longitudinal shank axis in a direction parallel to the flat surface, said catch having a sprung tongue extending alongside the shank, said catch being arranged to engage the recess pretensioned, the shank having (I) a recess for engaging said catch, and (ii) a beveled surface for moving the catch from a neutral position to a deflected position during initial insertion of the shank into the holder, said recess being spaced from said beveled surface and being sized to allow said catch to settle to a locking position in response to further insertion of said shank in said holder; and two outer cover plates connected together, and positioned on opposite sides of said middle plate.

* * * * *